US011028643B2

(12) United States Patent
Bruandet

(10) Patent No.: US 11,028,643 B2
(45) Date of Patent: Jun. 8, 2021

(54) DOWN THE HOLE DRILLING MACHINE AND METHOD FOR DRILLING ROCK

(71) Applicant: SANDVIK INTELLECTUAL PROPERTY AB, Sandviken (SE)

(72) Inventor: Olivier Bruandet, Tampere (FI)

(73) Assignee: SANDVIK INTELLECTUAL PROPERTY AB, Sandviken (SE)

( * ) Notice: Subject to any disclaimer, the term of this patent is extended or adjusted under 35 U.S.C. 154(b) by 0 days.

(21) Appl. No.: 16/617,841

(22) PCT Filed: May 31, 2018

(86) PCT No.: PCT/EP2018/064318
§ 371 (c)(1),
(2) Date: Nov. 27, 2019

(87) PCT Pub. No.: WO2018/220098
PCT Pub. Date: Dec. 6, 2018

(65) Prior Publication Data

US 2020/0109602 A1 Apr. 9, 2020

(30) Foreign Application Priority Data

Jun. 2, 2017 (EP) ..... 17174126

(51) Int. Cl.

| | |
|---|---|
| ***E21B 1/30*** | (2006.01) |
| ***E21B 1/24*** | (2006.01) |
| ***E21B 1/12*** | (2006.01) |
| ***E21B 1/38*** | (2006.01) |
| ***E21B 4/14*** | (2006.01) |
| ***E21B 1/00*** | (2006.01) |
| *E21B 7/02* | (2006.01) |
| *E21B 21/10* | (2006.01) |

(52) U.S. Cl.
CPC ..... *E21B 4/14* (2013.01); *E21B 1/00* (2013.01); *E21B 1/12* (2020.05); *E21B 1/24* (2020.05); *E21B 1/30* (2020.05); *E21B 1/38* (2020.05); *E21B 7/02* (2013.01); *E21B 21/10* (2013.01)

(58) Field of Classification Search
CPC ..... E21B 1/30; E21B 1/24; E21B 1/12; E21B 1/38; E21B 4/14
See application file for complete search history.

(56) References Cited

U.S. PATENT DOCUMENTS

| | | | | |
|---|---|---|---|---|
| 3,599,730 | A * | 8/1971 | Luthman | E21B 4/14 173/17 |
| 6,454,026 | B1 | 9/2002 | Shofner | |
| 2009/0188723 | A1 | 7/2009 | Aros | |
| 2013/0233626 | A1* | 9/2013 | Aros | E21B 4/14 175/296 |
| 2017/0088932 | A1 | 3/2017 | Plana et al. | |

* cited by examiner

*Primary Examiner* — Cathleen R Hutchins
(74) *Attorney, Agent, or Firm* — Corinne R. Gorski

(57) ABSTRACT

A down the hole rock drilling machine and a method of drilling rock. The drilling machine includes a reciprocating piston, which has a sleeve-like configuration. Inside a central opening of the piston is arranged one or more fluid passages for conveying pressurized fluid during the work cycle of an impact device of the drill machine.

9 Claims, 7 Drawing Sheets

DOWN THE HOLE DRILLING MACHINE AND METHOD FOR DRILLING ROCK

RELATED APPLICATION DATA

This application is a § 371 National Stage Application of PCT International Application No. PCT/EP2018/064318 filed May 31, 2018 claiming priority to EP 17174126.7 filed Jun. 2, 2017.

BACKGROUND OF THE INVENTION

The invention relates to a down the hole drilling machine comprising an impact device and especially to fluid conveyance inside the impact device. The drilling machine is provided with a reciprocating percussion piston, which is moved by controlling feeding an discharging pressurized fluid into an out of working chambers where working surfaces of the piston are located. The piston is configured to strike to a drill bit being connected directly to the drilling machine.

Further, the invention relates to a method for drilling rock.

Holes can be drilled in rock by means of various rock drilling machines. Drilling may be performed with a method combining percussions and rotation. Then the drilling is called percussive drilling. Further, percussive drilling may be classified according to whether an impact device is outside the drill hole or in the drill hole during the drilling. When the impact device is in the drill hole, the drilling is typically called down-the-hole drilling (DTH). Since the impact device is in the DTH drilling machine located inside the drill hole, structure of the impact device needs to be compact.

In the known DTH drilling machines efficiency of the impact devices are shown not to be satisfactory.

BRIEF DESCRIPTION OF THE INVENTION

It is an object of this invention to provide a novel and improved drilling machine and a method for drilling rock.

An idea of the disclosed solution is that the impact device comprises a piston provided with a longitudinal central opening passing axially through the piston. Thus, the piston has a sleeve-like configuration. An outer shell of the sleeve-like piston is solid, which means that the piston is without any transverse through openings extending between an outer surface and an inner surface. Thereby the sleeve-like piston is not provided with openable and closable transverse control openings. Further, at least fluid passages for feeding or supplying pressurized fluid into a top working chamber and bottom working chamber are located inside the central opening of the piston. In summary, the present solution discloses an improved way for pressurized fluid routing in DTH drilling machines.

An advantage of the disclosed solution is that when the fluid is controlled into both working chambers by means of the mentioned fluid passages inside the central opening of the piston, then top and bottom working areas of the piston inside the working chambers may be maximized. Increased size of the working areas affected by pressurized fluid means that greater impact pulses can be produced. Thereby effectivity of the impact device may be increased without increasing outer dimensions of the impact device. In known impact devices the fluid routing system comprises fluid passages outside the piston, whereby they limit size of working areas of the piston. Further, when the piston has no cross holes the structure of the piston is robust and durable.

A further advantage is that, when the drilling machine is pneumatically operated this solution also ensures as great space as possible for the supplied air and its pneumatic expansion during the work cycle.

An idea of an embodiment is that in addition to the feed or supply fluid passages, the fluid passages for discharging the pressurized fluid out of the top and bottom working chambers are also located inside the central opening of the piston. In other words, both feeding and venting of both working chambers is done through a piston bore whereby there is no need for discharging channels arranged around the piston. Owing to this, the structure may be compact and the piston may have large working surface areas. Further, controlling of the discharge flows may be executed without any dedicated discharge control elements, such as control sleeves, which simplifies the structure.

An idea of an embodiment is that connections between the working chambers and the fluid feed passages inside the central opening of the piston are opened and closed by the movements of the sleeve-like piston provided with the solid outer shell. In other words, the feed flows to both working chambers are controlled by the position of the piston. Further, if the discharge flows of both working chambers are also routed through the central opening of the piston, then the position of the piston controls also the discharge flows. An advantage of this embodiment is that there is no need for any separate movable control sleeves or valves for controlling the feeding and discharging. This simplifies the structure. The piston having the solid-sleeve configuration provides itself the needed control for the work cycle of the impact device.

An idea of an embodiment is that the impact device comprises a feed tube arranged inside the central opening of the piston. The feed tube arranged coaxially inside the sleeve-like piston is for controlling fluid flows of the impact device. The feed tube is a two-part structure comprising an outer feed tube and an inner feed tube. The outer feed tube is supported to an axial bore of the piston and the inner feed tube is arranged inside the outer feed tube. In other words, the feed tube is a double wall structure providing the structure with additional axial fluid passages inside the central opening of the piston. Thus, an advantage of the disclosed double feed tube is that the structure may comprise several fluid passages. There may be fluid passages between the piston and the outer feed tube, between the outer feed tube and the inner feed tube, and further, inside the inner feed tube.

An idea of an embodiment is that inside the central opening is the feed tube as is disclosed in the previous embodiment. The feed tube is an immobile element relative to the casing. Since the fluid flows are controlled by the movements of the piston, there is no need to move the feed tube in accordance with the work cycle.

An idea of an embodiment is that inside the central opening of the piston is the feed tube disclosed above. Contrary to the previous embodiment the feed tube is arranged axially movably relative to the casing. An advantage of this solution is that timing of opening and closing of fluid passages may be adjusted by adjusting axial position of the at least one of the tubes of the feed tube. Thereby it is possible to provide the drilling machine with an asymmetric timing feature for the fluid routing, for example. The axial position of the feed tube may be adjusted by means of adjusting screws, for example.

An idea of an embodiment is that the fluid routing inside the impact device is executed without the above disclosed features of the double wall system or double tube structure.

In this alternative solution inside the central opening of the piston may be two or more separate axial fluid channels for executing the fluid supply and discharge separately.

An idea of an embodiment is that the impact device comprises two separate feed tubes arranged inside the central opening of the piston. The feed tubes are not arranged coaxially inside the sleeve-like piston. One feed tube is for the upper working chamber and the other feed tube is for the lower working chamber. Thus, there are separate parallel feed tubes for controlling fluid flows of the impact device. This embodiment is an alternative to one single coaxial feed tube.

An idea of an embodiment is that inside the central opening of the piston is a feed tube comprising an outer feed tube and an inner feed tube arranged inside the outer feed tube. The double wall feed tube provides the structure inside the piston with three axial passages. Inside the inner feed tube is a discharge passage whereby the discharging of the fluid from at least the top working chamber is configured to be executed via the discharge passage. Between the outer feed tube and the inner feed tube is a feed passage, which is connected to the inlet port at a top end and is provided with constant fluid supply during the working cycle of the impact device. And further, between the outer tube and the piston is a top feed passage for conveying fluid from the feed passage to the top working chamber and being opened and closed by the piston for controlling the working cycle. According to an idea of a further embodiment also the bottom working chamber is discharged via the discharge passage of the inner feed tube.

An idea of an embodiment is that inside the central opening of the piston is the feed tube comprising the above disclosed double wall or double tube structure. The inner feed tube is arranged to extend axially to the drill bit. The bottom end of the inner tube is arranged inside a central opening or bore of the drill bit. Between the inner feed tube and the drill bit may be fluid tight connection. The fluid flow discharged via the inner passage of the inner feed tube may flow through the bore of the drill bit out of the impact device. The bore of the drill bit is in fluid connection with at least one flushing channel extending to a bottom face of the drill bit. An advantage of this embodiment is that the inner feed tube provides the impact device with a convenient and compact fluid path.

An idea of an embodiment is that the feed tube comprises at least one transverse discharging opening at the top part of the feed tube and passing through the inner tube and the outer tube for discharging the top working chamber to the axial discharge passage when being opened by the piston.

An idea of an embodiment is that at the bottom end portion of the drilling machine is a bottom sleeve surrounding the bottom end portion of the piston and the top end portion of the drill bit. The bottom sleeve comprises fluid passages allowing fluid connection from the bottom working chamber to at least one discharging channel passing the drill bit and directing the discharged fluid to sides of the drill bit. The bottom sleeve is connected immovably to the casing of the drilling machine. By means of the bottom sleeve, suitable fluid passages may be easily arranged at the end structure of the impact device. The mentioned fluid connection for discharging the bottom working chamber is controlled by the axial movements of the piston.

An idea of an embodiment is that the drilling machine is a pneumatically operable device and the fluid is pressurized gas.

An idea of an embodiment is that the drilling machine and the impact device is a hydraulically operated device. The device may be used by means of pressurized water, for example.

The above disclosed embodiments and their features may be combined.

BRIEF DESCRIPTION OF THE FIGURES

Some embodiments of the invention will be explained in greater detail in the attached drawings, in which.

In the figures, some embodiments of the invention are shown simplified for the sake of clarity. Like reference numerals refer to like parts in the figures.

DETAILED DESCRIPTION OF SOME EMBODIMENTS OF THE INVENTION

Figure 1:
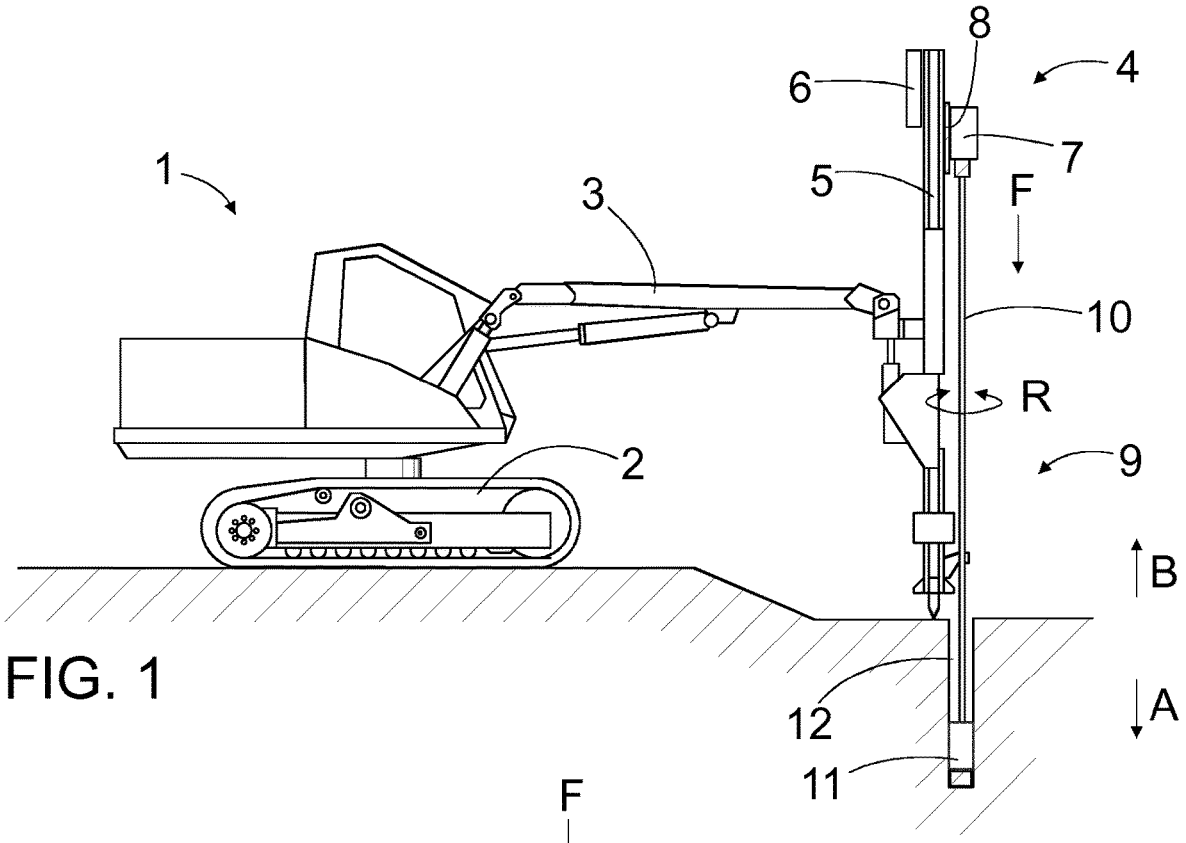
FIG. 1 shows schematically a rock drilling rig provided with a DTH rock drilling machine.

FIG. 1 shows a rock drilling rig 1 that comprises a movable carrier 2 provided with a drilling boom 3. The boom 3 is provided with a rock drilling unit 4 comprising a feed beam 5, a feed device 6 and a rotation unit 7. The rotation unit 7 may comprise a gear system and one or more rotating motors. The rotation unit 7 may be supported to a carriage 8 with which it is movably supported to the feed beam 5. The rotation unit 7 may be provided with drilling equipment 9 which may comprise one or more drilling tubes 10 connected to each other, and a DTH drilling machine 11 at an outermost end of the drilling equipment 9. The DTH drilling machine 11 is located in the drilled bore hole 12 during the drilling.

Figure 2:
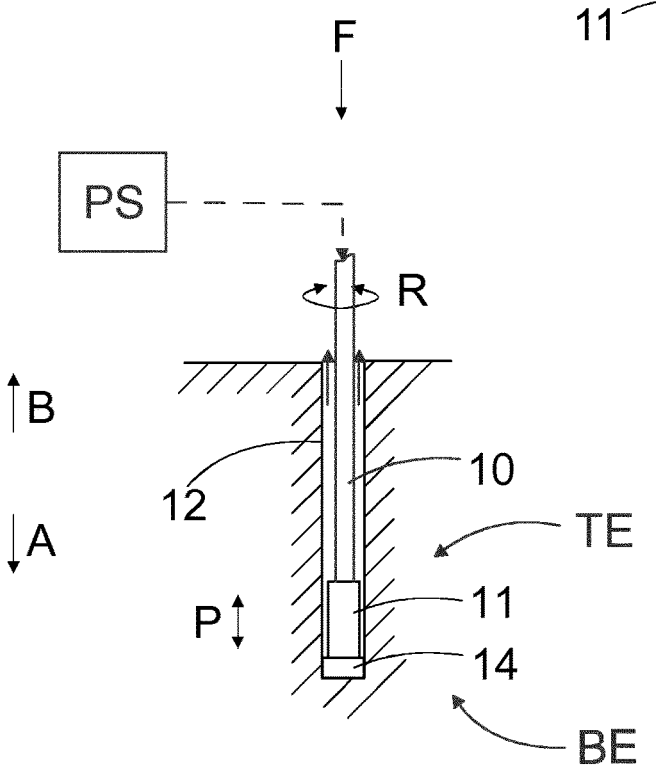
FIG. 2 shows schematically a DTH drilling machine at a bottom of a drill hole.

FIG. 2 shows that the DTH drilling machine 11 comprises an impact device 13. The impact device 13 is at the opposite end of the drilling equipment 9 in relation to the rotation unit 7. During drilling, a drill bit 14 is connected directly to the impact device 13, whereby percussions P generated by the impact device 13 are transmitted to the drill bit 14. The drilling equipment 9 is rotating around its longitudinal axis in direction R by means of the rotation unit 7 shown in FIG. 1 and, at the same, the rotation unit 7 and the drilling equipment 9 connected to it are fed with feed force F in the drilling direction A by means of the feed device 6. Then, the drill bit 14 breaks rock due to the effect of the rotation R, the feed force F and the percussion P. Pressurized fluid is fed from a pressure source PS to the drilling machine 11 through the drilling tubes 10. The pressurized fluid may be compressed air and the pressure source PS may be a compressor. The pressure fluid is directed to influence to working surfaces of a percussion piston of the drilling machine and to cause the piston to move in a reciprocating manner and to strike against impact surface of the drill bit. After being utilized in working cycle of the drilling machine 11 pressurized air is allowed to discharge form the drilling machine 11 and to thereby provide flushing for the drill bit 14. Further, the discharged air pushes drilled rock material out of the drill hole in an annular space between the drill hole and the drilling equipment 9.

FIG. 2 indicates by an arrow TE an upper end or top end of the drilling machine 11 and by an arrow BE a lower end or bottom end of the drilling machine.

Figure 3:
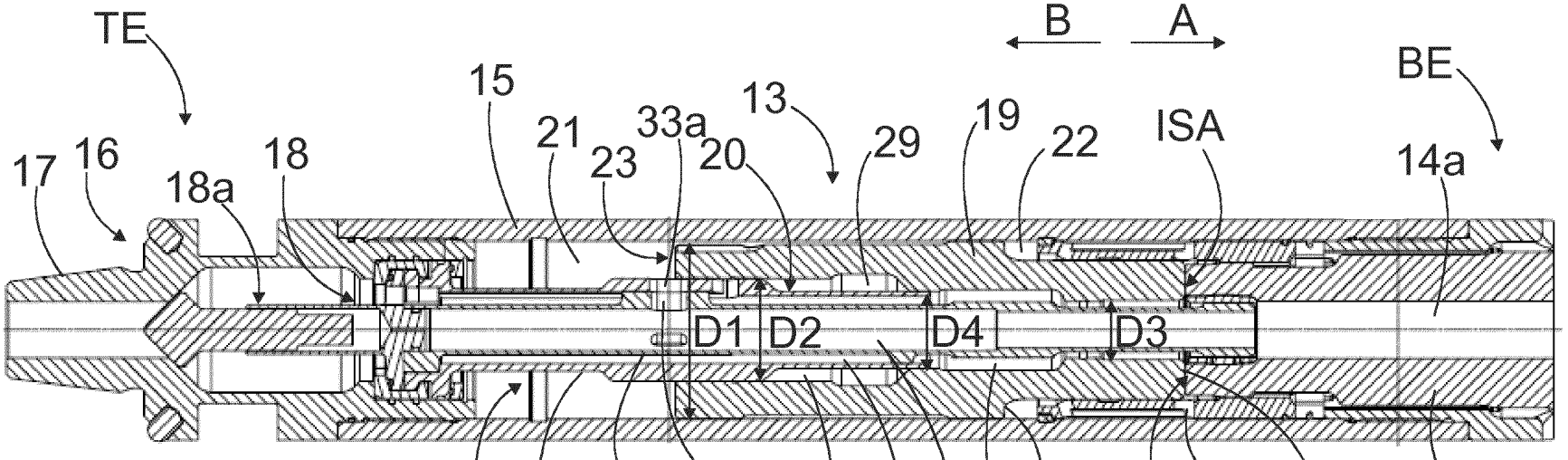
FIGS. 3 and 4 show schematically two different cross-sectional views of a DTH drilling machine.
Figure 4:
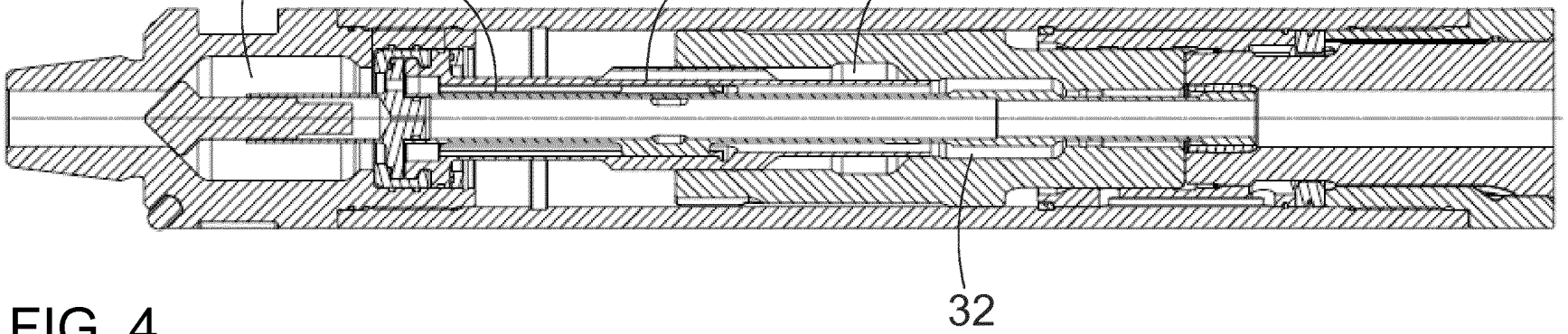

FIGS. 3 and 4 disclose a DTH drilling machine 11 and its impact device 13. The cross-sections are shown at differing points in FIGS. 3 and 4. The drilling machine comprises an elongated casing 15, which may be a sleeve-like frame piece. At a top end TE of the casing 15 is a connection piece 16 by means of which the drilling machine 11 can be connected to a drill tube. The connection piece 16 may comprise threaded connecting surfaces 17. In connection with the connection piece 16 is an inlet port 18 for feeding pressurized fluid to the impact device 13. The inlet port 18 may comprise valve means 18*a*, which allow feeding of fluid towards the impact device but prevent flow in an opposite direction. The impact device 13 comprises a piston 19 which is arranged to be moved in a reciprocating manner during its work cycle. At a bottom end BE of the piston is an impact surface ISA arranged to strike an impact surface ISB at a top end of a drill bit 14. As can be noted, the piston 19 is a sleeve-like piece comprising an outer surface supported against an inner surface of the casing, and an inner surface defining a central opening 20. The piston 19 is without any transverse channels or openings and only comprises the central opening 20 extending from end to end. The central opening 20 is utilized for conveying pressure fluid from the inlet port 18 to a top working chamber 21 and to a bottom working chamber 22. Thus, there is no need for feed fluid passages around the piston 19. The piston 19 has a top working surface 23 which is affected by the pressure prevailing in the top working chamber 21 and is defined by diameters D1 and D2, wherein D1 is outer diameter of the piston and D2 is diameter of the central opening at the top end. At the bottom end of the piston is a bottom working surface 24 defined by diameters D1 and D3, wherein D3 is diameter of central opening at the bottom end.

Inside the central opening 20 may be a feed tube 25 for conducting the fluid flows. The feed tube 25 may extend from the inlet port 18 to the drill bit 14. The feed tube 25 may comprise an outer feed tube 25*a* supported to the central opening 20, and an inner feed tube 25*b* arranged inside the outer feed tube 25*a*. The two feed tube components 25*a*, 25*b* provide the feed tube 25 with double wall structure and may create three axial fluid passages inside the central opening 20 of the piston 19. Then a fluid passage 26 may be formed between the piston 19 and the outer feed tube 25*a*, a fluid passage 27 may be between the outer feed tube 25*a* and the inner feed tube 25*b*, and further, inside the inner feed tube 25*b* is a fluid passage 28. Furthermore, inside the piston 19 is a top feed chamber 29, which is limited radially by the outer feed tube 25*a*. The top feed chamber 29 is in continuous fluid connection to top working chamber 21 by means of axial fluid passages 30 of the outer feed tube 25*a*.

At the inlet port 18 is a pressure space 31 wherein prevails substantially constant pressure. The pressure space 31 is in constant fluid connection with a fluid passage 27 and a fluid space 32. Thus, between the outer feed tube 25*a* and the inner feed tube 25*b* prevails constant fluid pressure, which may be conveyed to the working chambers 21 and 22 in accordance with movement of the piston 19.

The feed tubes 25*a*, 25*b* are arranged immovably relative to each other and typically the entire feed tube 25 is arrange immovably relative to the casing 15. Then the piston 19 moves relative to the feed tube 25 and opens and closes transverse openings of the outer feed tube 25*a* and the inner feed tube 25*b*. The movement of the piston 19 also opens and closes axial connection between the fluid space 32 and the bottom working chamber 22 as will be disclosed below.

Figure 5:
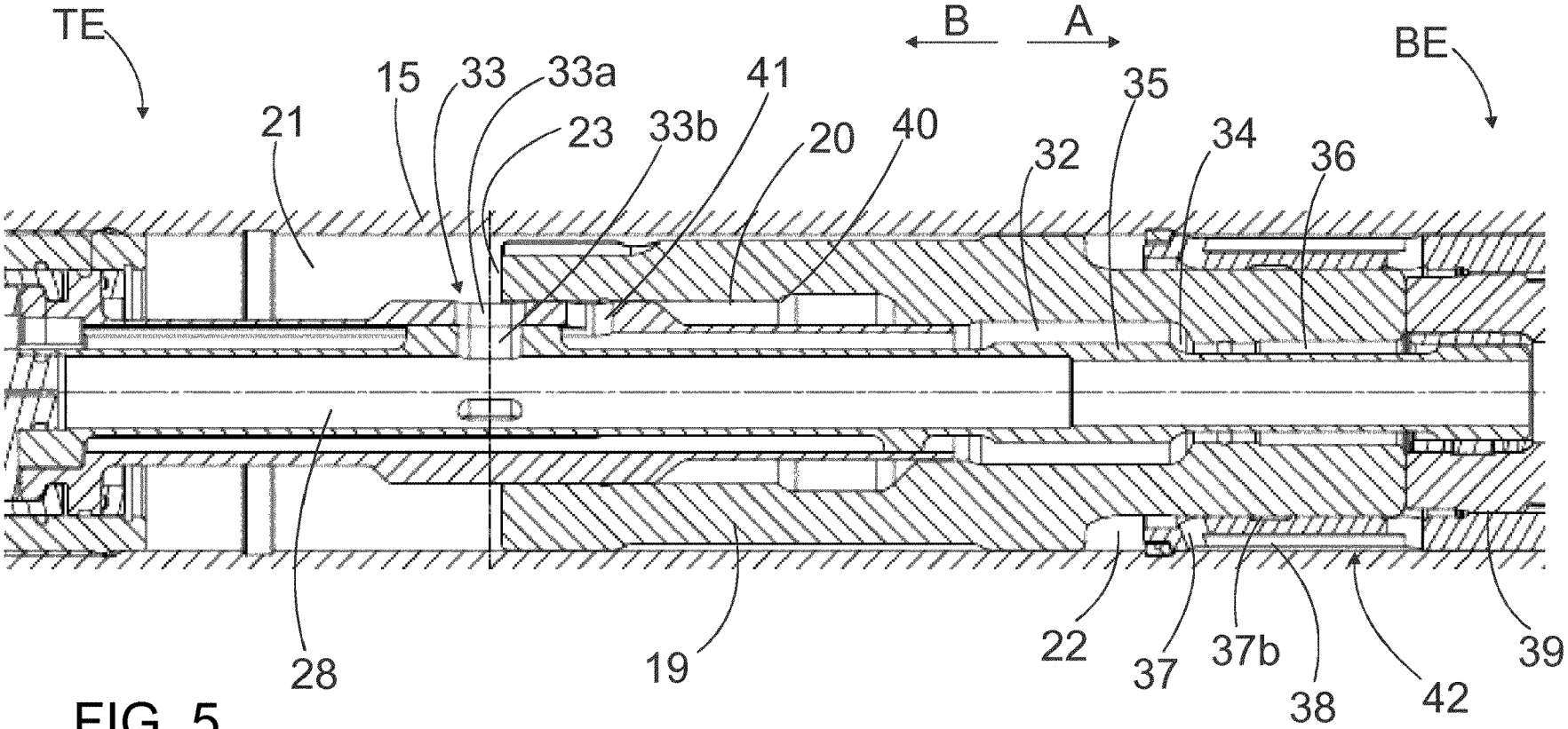
FIG. 5 shows schematically and enlarged a cross sectional view of part of the drilling machine of FIGS. 3 and 4.

FIG. 5 discloses a situation wherein the piston 19 is moved to its right most position and is at an impact point. Then the top end of the piston 19 opens fluid connection from the top working chamber 21 through the transverse openings 33 of the feed tube 25 to the fluid passage of the inner feed tube 25*b*. Thereby the top working chamber 21 is discharged through the fluid passage 28 arranged inside the central opening 20 of the piston. The openings 33 are formed of aligned openings 33*a* and 33*b* of the inner and outer feed tubes 25*a*, 25*b*. The inner fluid passage 28 of the inner feed tube 25*b* extends to a central bore 14*a* of the drill bit 14 whereby the top chamber 21 is discharged through the drill bit.

FIG. 5 further discloses that when the piston 19 moves in the impact direction A towards the impact point, then a fluid connection 34 opens between a control shoulder 35 and a bottom end portion 36 of the central opening 20 of the piston 19. The pressure fluid may then flow from the fluid space 32 to the bottom working chamber 22 since the fluid space 32 is constantly connected to the inlet port 18. This way feeding of the bottom chamber 22 is executed by means of fluid passages arranged inside the central bore 20 of the piston 19.

As disclosed above, the top working chamber 21 is discharged through the fluid passage 28 and the bottom working chamber 22 is pressurized. Pressure affecting to the bottom working surfaces 24 causes the piston 19 to move towards the return direction B. As the piston 19 moves toward the top end TE, then the control shoulder 35 closes the fluid connection 34. The bottom chamber 22 becomes then a closed pressure space inside which the pressurized fluid may expand, in case the used fluid is pressure air. The expanding fluid in the bottom chamber 22 forces the piston 19 to move in the return direction B and then the top end of the piston 19 closes connection to the transverse openings 33 whereby the top chamber 21 becomes a closed space. The piston 19 continues its movement in the return direction B and the bottom end of the piston 19 opens a discharge passage 37*b* through which the bottom chamber 22 is discharged via a passage 38*b* and through the side of the drill bit. However, the piston 19 moves still in the return direction B and a shoulder 40 opens passages 41 between the fluid passage 27 and the top feed chamber 29. The top feed chamber 29 is then connected to the feed pressure. The same pressure prevails also in the top working chamber 21, since the top feed chamber 29 and the top working chamber 21 are in continuous fluid connection through the axial fluid passages 30. Then top dead point of the piston 19 is reached and movement direction of the piston 19 is changed towards the impact direction A. When the piston 19 moves in the impact direction A the shoulder 40 closes the passages 41 and the top working chamber 21 becomes a closed pressure space inside which the fed fluid expands. The movement of the piston 19 causes the top end of the piston to close discharge connection from the bottom working chamber 22 to the fluid passage 37*b*. The piston continues its movement in the impact direction A and the top end of the piston 19 opens the transverse openings 33 and thereby allow the top working chamber 21 to be discharged to the fluid passage 28 inside the inner feed tube 25*b*. When the piston continues its movement the end portion 36 of the central opening passes the control shoulder 34 and opens the fluid passage 34 for feeding fluid to the bottom working chamber 22. The piston 19 impacts the drill bit 14 and the work cycle may continue in a similar manner.

Figure 6:
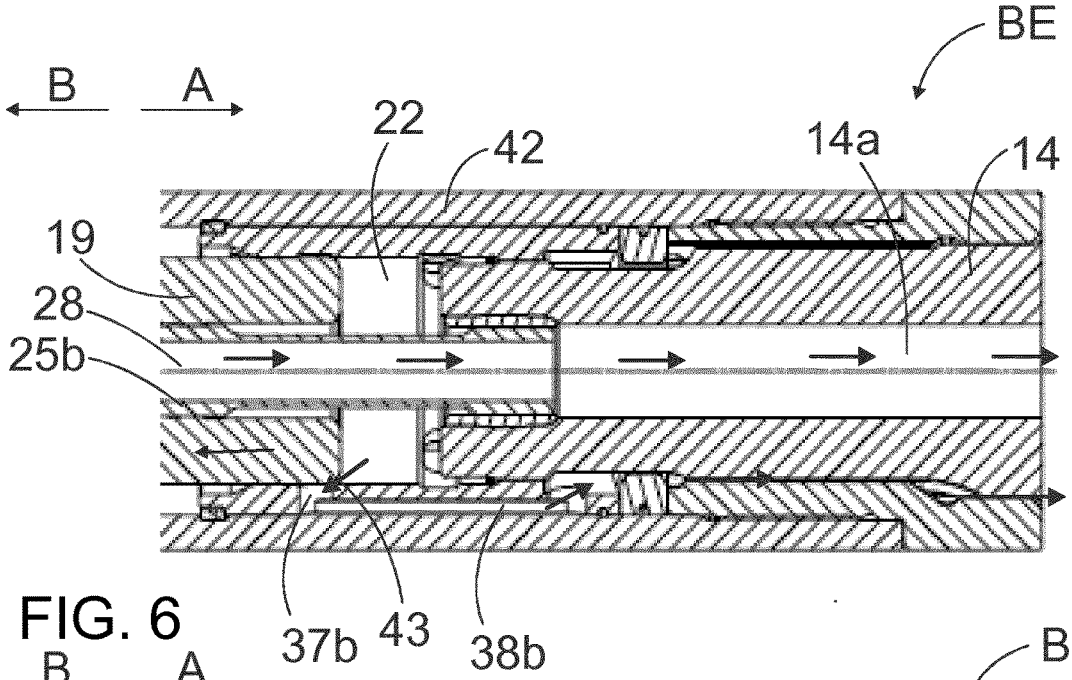
FIG. 6 shows schematically timing of discharge of a bottom chamber and utilization of a bottom sleeve.

FIG. 6 discloses in detail the discharge of the bottom chamber 22. The fluid passages 37*b* and 38*b* are located in a bottom sleeve 42. The bottom sleeve 42 surrounds the bottom end portion of the piston 19 and the top end portion of the drill bit 14. The fluid passages 37*b* and 38*b* direct the discharging fluid flow to sides of the drill bit 14. When the piston 19 moves in the return direction B an edge 43 of the piston 19 opens the discharge connection.

Figure 7:
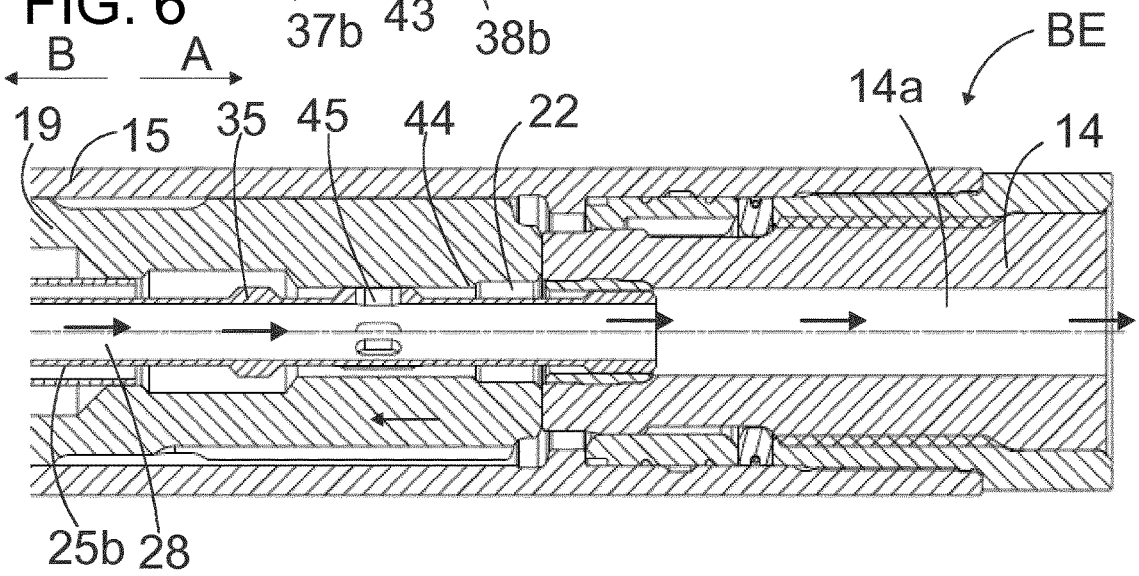
FIG. 7 shows schematically an alternative discharging of the bottom chamber trough an axial passage of an inner feed tube.

FIG. 7 discloses an alternative solution which is without the bottom sleeve of FIGS. 3-6. In FIG. 7 the bottom working chamber 22 is discharged via the discharge passage 28 of the inner feed tube 25*b*. Thus, in this solution both working chambers 21, 22 are discharged to the central bore 14*a* of the drill bit 14. When the piston 19 moves in the return direction B, then an edge 44 opens transverse openings 45, which are locating at the bottom end of the inner tube 25*b*. A control shoulder 35 closes fluid connection between a top feed chamber 29 and the bottom work chamber 22 before the discharge.

Figure 8:
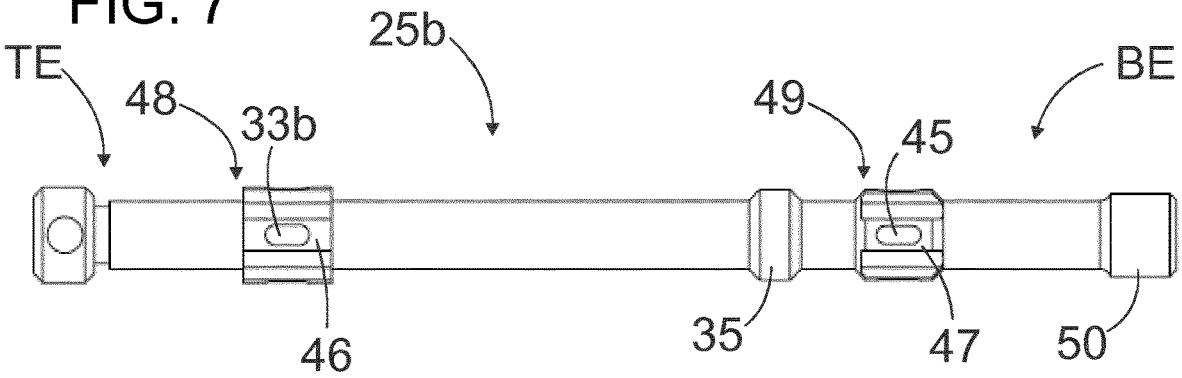
FIG. 8 shows schematically an inner feed tube allowing discharge of a top working chamber and a bottom working chamber trough an inner axial passage.

FIG. 8 discloses an inner feed tube 25*b* comprising transverse openings 33*b* for the discharge of top working chamber and transverse openings 45 for the discharge of bottom working chambers. The openings 33*b* and 45 are located at grooves 46, 47 of enlargements 48, 49. The grooves 46, 47 connect fluid spaces on both sides of the enlargements 48, 49. At the bottom end BE of the inner feed tube 25*b* may be an end part 50, which may be connected fluid tightly to a central bore 14*b* of a drill bit 14.

Figure 9:
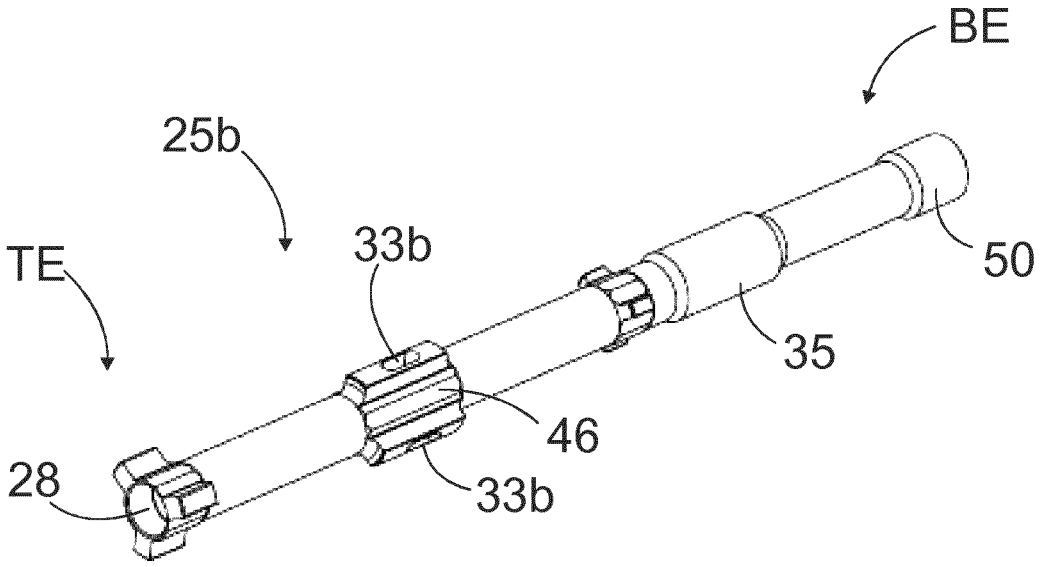
FIG. 9 shows schematically an inner feed tube suitable for impact devices of FIGS. 3-5 wherein only the top working chamber is discharged through the inner axial passage.

FIG. 9 discloses an inner feed tube 25*b* suitable for impact devices of FIGS. 3-5 wherein only the top working chamber is discharged through an inner axial passage 28. The inner feed tube comprises transverse openings 33*b* for connecting the top working chamber and the passage 28. The inner feed tube also comprises a control shoulder 35 and an end part 50.

Figure 10:
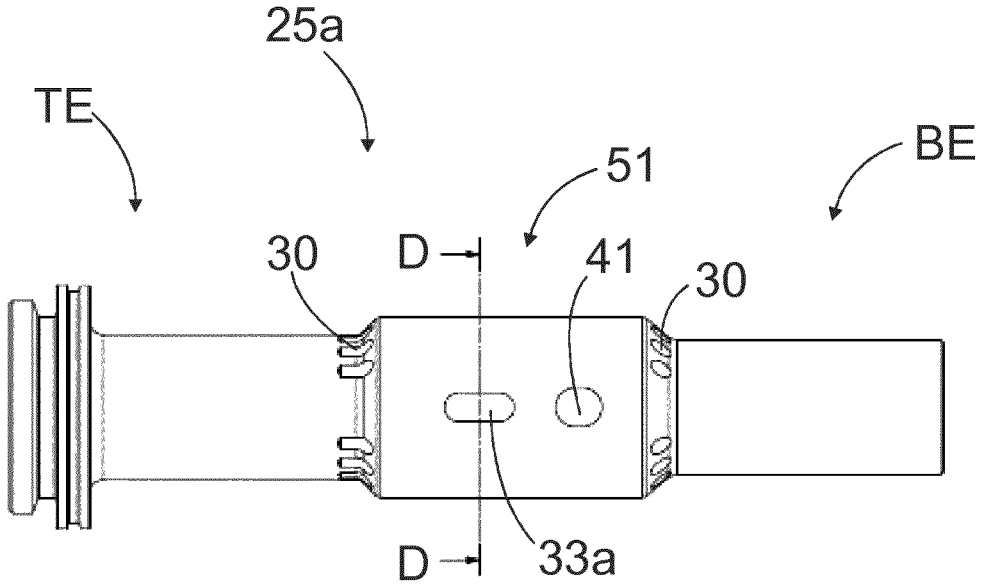
FIG. 10 shows schematically an outer feed tube and FIG. 11 is a cross section D-D of FIG. 10.
Figure 11:
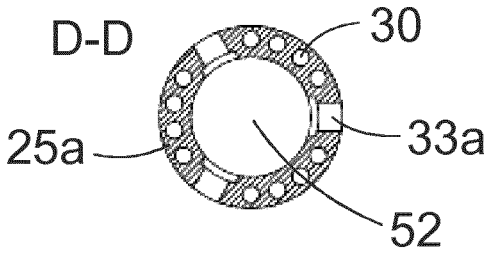

FIGS. 10 and 11 disclose an outer feed tube 25*a*. The outer feed tube 25*a* comprises an enlargement 51 at its longitudinal middle section. Several axial passages 30 pass through the enlargement 51 and connect pressure space on opposite sides of the enlargement 51. Further, the enlargement 51 comprises several transverse discharge openings 33*a* and feed openings 41 passing through the sleeve-like structure. Inside the outer tube 25*a* is a central space 52 inside which the inner feed tube may be arranged.

Figure 12:
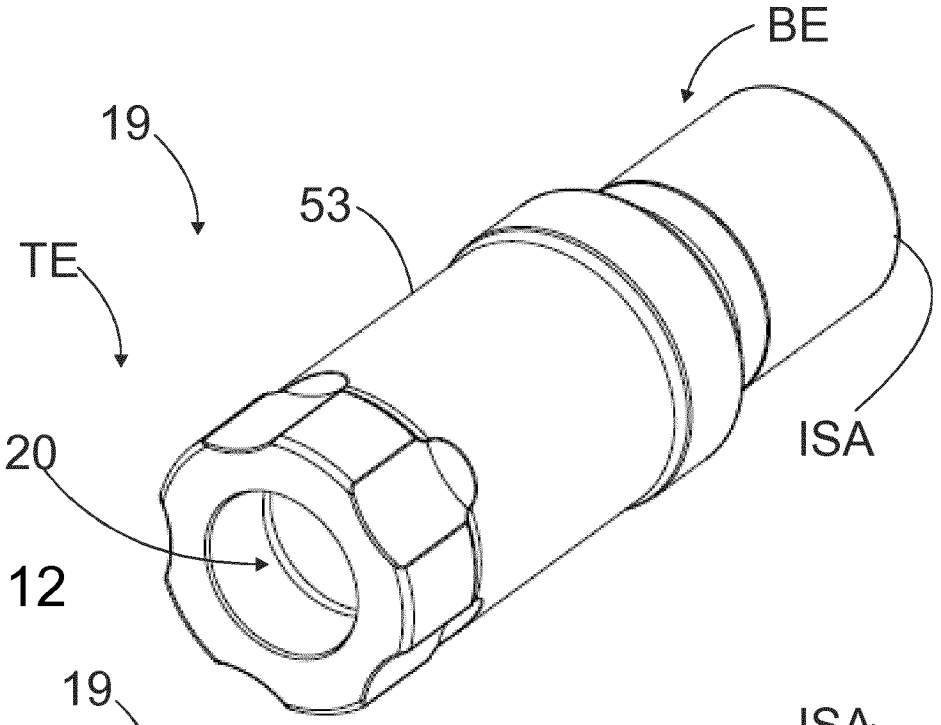
FIG. 12 shows schematically a piston of an impact device of FIGS. 3-5 and FIG. 13 is a cross-sectional view of the sleeve-like piston of FIG. 12, FIGS. 14-16 show schematically cross-sectional views of possible alternative sleeve-like pistons and axial fluid passages inside central openings of the pistons.
Figure 13:
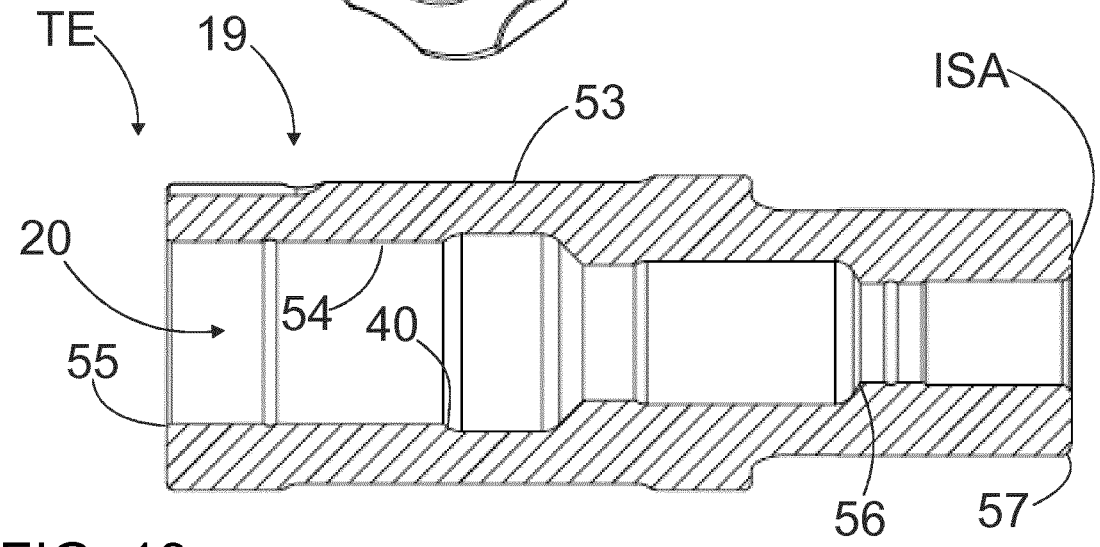

FIGS. 12 and 13 disclose the sleeve-like piston 19. Between an outer surface 53 and an inner surface 54 are no holes or transverse apertures whereby the piston has a solid outer core. Inside the piston 19 is the central opening 20 inside which axial fluid passages and feed tubes may be arranged. Since the reciprocating movement of the piston 19 is configured to control the work cycle of the impact device, the piston 19 is provided with edges 40, 55, 56 and 57 or control surfaces for opening and closing the fluid passages, as it is disclosed above.

Figure 14:
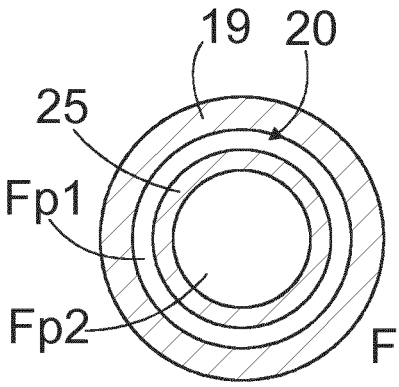
Figure 15:
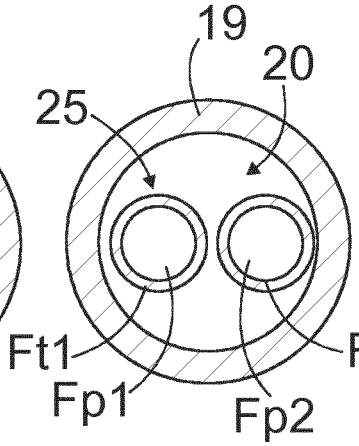
Figure 16:
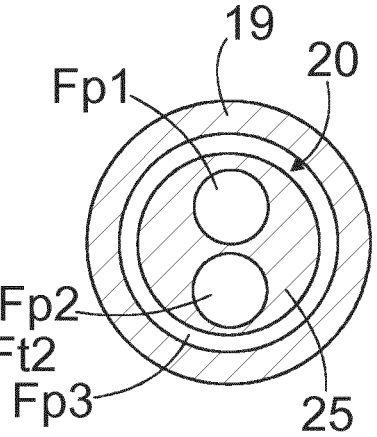

FIGS. 14-16 disclose some alternative sleeve-like pistons 19 and axial fluid paths Fp1-Fp3 inside central openings 20 of the pistons 19. The FIGS. 14-16 are strongly simplified for improving clarity. In FIG. 14 inside the central opening 20 is one feed tube 25, whereby two fluid paths Fp1 and Fp2 is formed. In FIG. 15 there are two separate feed tubes Ft1 and Ft2 and their fluid paths Fp1 and Fp2. Further, in FIG. 16 one single feed tube 25 comprises two internal flow paths Fp1 and Fp2.

Figure 17:
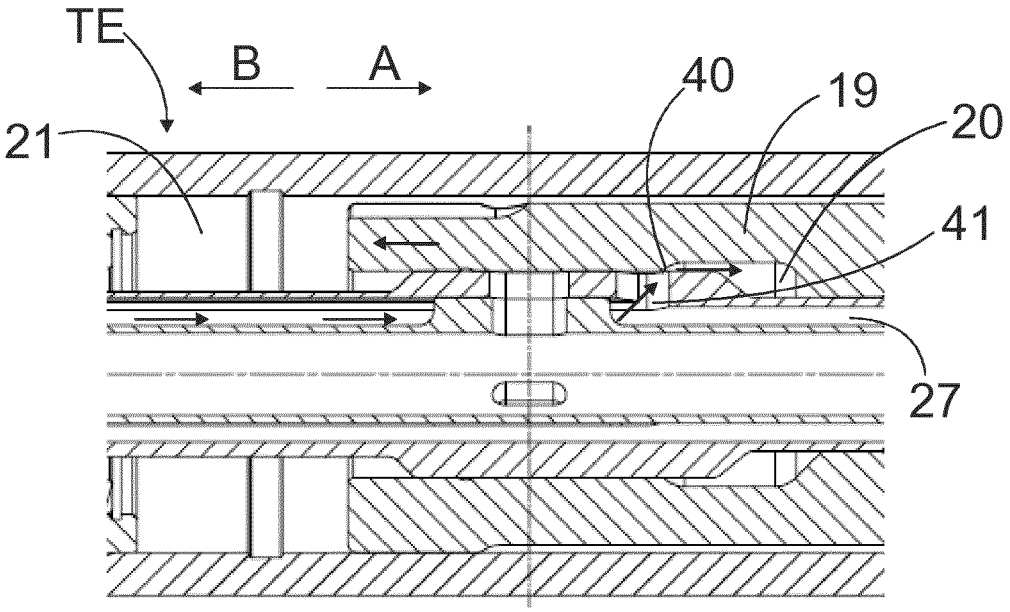
FIG. 17 shows schematically a cross-sectional view of the top end of the impact device when the piston is in a top feed timing position.

FIG. 17 discloses a portion of the impact device at the top end TE and in situation when the piston 19 is moving in the return direction B and the edge 40 opens connection to the feed passage 41 so that fluid can flow from the axial passage 27 to the top feed chamber 20. Since the top feed chamber 20 and the top working chamber 21 are connected by means of axial channels 30 shown in FIGS. 4 and 10, the same pressure will prevail in both spaces 20, 21 after the passage 41 is opened.

Figure 18:
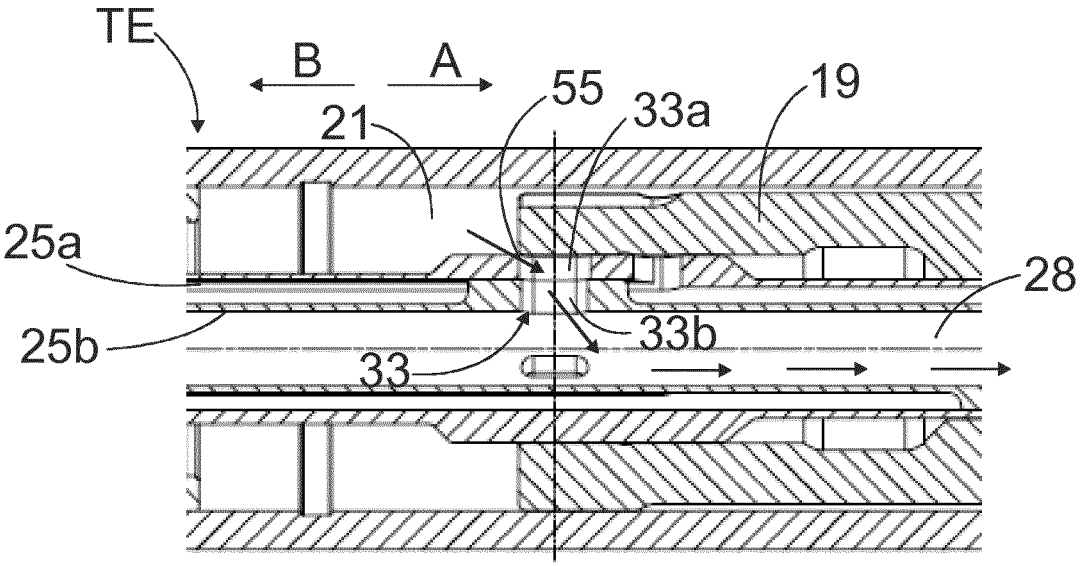
FIG. 18 shows schematically a cross-sectional view of the top end of the impact device when the piston is in a top vent timing position.

FIG. 18 discloses a portion of the impact device at the top end TE top end of the impact device, and in situation when the piston 19 is moving in the impact direction A. Then the edge 55 or control surface opens transverse fluid passage 33 form the top working chamber 21 to the discharge passage 28, whereby the top working chamber 21 is discharged through the inner feed tube 25*b*.

The drawings and the related description are only intended to illustrate the idea of the invention. Details of the invention may vary within the scope of the claims.

The invention claimed is:

1. A down the hole drilling machine comprising:

an elongated casing having a top end and a bottom end;

a fluid powered piston arranged movably inside the casing;

a top working chamber disposed at a top side of the piston;

a bottom working chamber disposed at a bottom side of the piston;

fluid passages and control elements arranged for controlling feeding and discharging pressurized fluid into and out of the top and bottom working chambers for generating a working cycle of the piston, wherein the piston has reciprocating movement in an impact direction and a return direction;

an inlet port disposed at the top end of the casing for feeding the pressurized fluid; and a drill bit connectable to the bottom end of the casing, the drill bit being provided with an impact surface facing towards the piston for receiving impacts of the piston, and wherein the piston includes a longitudinal central opening passing axially through the piston, the piston having an elongated sleeve-like configuration including an outer surface and an inner surface, wherein the sleeve-like piston has a solid outer shell, whereby the piston is without any transverse through openings extending between the outer surface and the inner surface, and wherein at least the fluid passages for feeding the pressurized fluid into both the bottom and top working chambers are located inside the central opening of the piston, wherein inside the central opening of the piston is a feed tube having an outer feed tube and an inner feed tube arranged inside the outer feed tube, wherein inside the inner feed tube is a discharge passage whereby the discharging of the fluid from at least the top working chamber is configured to be executed via the discharge passage, and between the outer feed tube and the inner feed tube is a feed passage, which is connected to the inlet port and is provided with constant fluid supply during the working cycle.

2. The down the hole drilling machine as claimed in claim 1, wherein at least the connections between the working chambers and the fluid feed passages inside the central opening of the piston are opened and closed by the movements of the sleeve-like piston provided with the solid outer shell.

3. The down the hole drilling machine as claimed in claim 1, wherein inside the central opening of the piston is a feed tube having an outer feed tube and an inner feed tube arranged inside the outer feed tube, and wherein the fluid passages are formed between the piston and the outer feed tube, between the outer feed tube and the inner feed tube, and further, inside the inner feed tube.

4. The down the hole drilling machine as claimed in claim 1, wherein between the outer feed tube and the piston is a top feed passage for conveying fluid from the feed passage to the top working chamber and being opened and closed by the piston.

5. The down the hole drilling machine as claimed in claim 4, wherein the bottom working chamber is discharged via the discharge passage of the inner feed tube.

6. The down the hole drilling machine as claimed in claim 1, wherein inside the central opening of the piston is a feed tube having an outer feed tube and an inner feed tube arranged inside the outer feed tube, and wherein the inner feed tube extends to the drill bit and a bottom end of the inner tube is located inside a central opening of the drill bit.

7. The down the hole drilling machine as claimed in claim 1, wherein the drilling machine is a pneumatically operable device and the fluid is pressurized gas.

8. A method for drilling rock, comprising:

drilling rock with a down the hole rock drilling machine, which comprises at least a casing, a sleeve-like piston located inside the casing and a drill bit disposed at a bottom end of the casing;

moving the piston in a reciprocating manner inside the casing in an impact direction and a return direction by feeding and discharging pressurized fluid to a top working chamber and at a bottom working chamber, which are locating on opposite sides of the piston;

controlling during an operating cycle the feeding and discharging of the fluid by means of the movements of the piston; and striking an impact surface of the drill bit by the piston;

controlling the fluid flows during the operating cycle by a solid outer shell of the piston; and feeding the pressurized fluid into the top and bottom working chambers through at least one fluid passage which is located inside a central opening of the piston, wherein inside the central opening of the piston is a feed tube having an outer feed tube and an inner feed tube arranged inside the outer feed tube, wherein inside the inner feed tube is a discharge passage whereby the discharging of the fluid from at least the top working chamber is configured to be executed via the discharge passage, and between the outer feed tube and the inner feed tube is a feed passage, which is connected to an inlet port of the casing and is provided with constant fluid supply during the operating cycle.

9. The method according to claim 8, further comprising discharging the fluid from the top working chamber through the at least one fluid passage which is located inside the central opening of the piston.

* * * * *